US009609947B1

(12) United States Patent
Tassin et al.

(10) Patent No.: US 9,609,947 B1
(45) Date of Patent: Apr. 4, 2017

(54) HINGE MOUNTED CABINET

(71) Applicants: Timothy Wayne Tassin, Naples, FL (US); Christian Tassin, Gainesville, FL (US)

(72) Inventors: Timothy Wayne Tassin, Naples, FL (US); Christian Tassin, Gainesville, FL (US)

(73) Assignee: Hingenuity International, LLC, Naples, FL (US)

( * ) Notice: Subject to any disclaimer, the term of this patent is extended or adjusted under 35 U.S.C. 154(b) by 0 days.

(21) Appl. No.: 15/161,330

(22) Filed: May 23, 2016

(51) Int. Cl.

| | |
|---|---|
| ***A47B 97/00*** | (2006.01) |
| ***A47B 81/00*** | (2006.01) |
| ***A47B 96/06*** | (2006.01) |
| ***A47B 47/03*** | (2006.01) |

(52) U.S. Cl.
CPC ..... *A47B 81/00* (2013.01); *A47B 47/03* (2013.01); *A47B 96/06* (2013.01)

(58) Field of Classification Search
CPC ..... A47B 81/00; A47B 96/06; A47B 46/00; A47B 47/03
USPC ..... 312/257.1, 263, 205, 321.5, 291, 249.2, 312/249.1, 249.7, 246
See application file for complete search history.

(56) References Cited

U.S. PATENT DOCUMENTS

| | | | | |
|---|---|---|---|---|
| 714,686 | A | 12/1902 | Flint | 312/114 |
| 750,193 | A | 1/1904 | James | 312/292 |
| 767,232 | A | 8/1904 | McClung | |
| 1,006,481 | A | 10/1911 | Johnson et al. | 312/225 |
| 1,212,028 | A | 1/1917 | Dowling | 312/101 |
| 1,282,368 | A | 10/1918 | Behl | 160/328 |
| 1,464,352 | A | 8/1923 | Cox | 297/14 |
| 1,485,714 | A | 3/1924 | Roach | 312/300 |
| 1,543,980 | A | 6/1925 | Blood | 312/290 |
| 1,731,746 | A | 10/1929 | Hunter | |
| 1,906,208 | A | 4/1933 | Greenberg | 312/248 |
| 1,927,398 | A | 9/1933 | Glasser | 62/377 |
| 1,980,730 | A | 11/1934 | Matchette | |
| 1,991,951 | A | 2/1935 | Matchette | 312/248 |
| 2,019,054 | A | 10/1935 | Manz | 312/248 |
| 2,122,680 | A | 7/1938 | Dart | 62/377 |
| 2,450,337 | A | 9/1948 | Hearst | 312/323 |
| D152,384 | S | 1/1949 | Weaver | |
| 2,604,156 | A | 7/1952 | Lillethorup | 160/92 |
| 2,907,617 | A | 10/1959 | Worrell | |
| 3,043,523 | A | 7/1962 | Hogstrom | 239/274 |
| 3,216,774 | A | 11/1965 | Figurski | 312/204 |
| 3,287,079 | A | 11/1966 | Courson | 312/291 |
| 3,431,591 | A | 3/1969 | Betso | 16/265 |
| 3,545,134 | A | 12/1970 | Dargene | 49/501 |
| 4,165,852 | A | 8/1973 | Chervenak | |
| 3,822,925 | A | 7/1974 | Osroff | 312/242 |
| 3,834,782 | A | 9/1974 | Pampinella | |
| 3,869,752 | A | 3/1975 | Klay | 16/234 |

(Continued)

*Primary Examiner* — Leslie A Nicholson, III
*Assistant Examiner* — Kimberley S Wright
(74) *Attorney, Agent, or Firm* — Livingston Loeffler, P.A.; Edward M. Livingston, Esq.; Bryan L. Loeffler, Esq.

(57) ABSTRACT

A hinge mounted cabinet (1) that can be assembled from one or more sections (22) using a plurality of internal support channels (15) that are locked together using splines (23) and caps (31, 32) to form a main body (2) of the cabinet. An exterior support channel (39) allows hinge hanging brackets (40) to be easily positioned to accommodate various sized door and hinge configurations.

17 Claims, 5 Drawing Sheets

(56) References Cited

U.S. PATENT DOCUMENTS

| | | | | |
|---|---|---|---|---|
| 3,906,670 | A | 9/1975 | Burton | |
| 3,962,749 | A | 6/1976 | Abolins | 16/382 |
| 4,377,314 | A | 3/1983 | Gevers | 312/297 |
| 4,489,459 | A | 12/1984 | Kempel | 16/248 |
| 4,699,437 | A | 10/1987 | Genereaux | |
| 4,721,212 | A | 1/1988 | Lowe | A47G 25/0685 16/223 |
| 5,349,909 | A | 9/1994 | Smit et al. | 108/107 |
| 5,505,317 | A | 4/1996 | Rulis et al. | |
| 5,524,980 | A | 6/1996 | Carter et al. | 312/351 |
| 5,560,112 | A | 10/1996 | Stein et al. | |
| 5,820,238 | A | 10/1998 | Lambright | 312/291 |
| 5,984,441 | A | 11/1999 | Stokhuijzen | |
| 6,003,964 | A * | 12/1999 | Baker | A46B 17/04 312/206 |
| 6,457,278 | B1 | 10/2002 | Fleming | |
| 6,616,253 | B1 | 9/2003 | Greaux | 312/248 |
| 6,647,664 | B1 | 11/2003 | Kochan, Sr. | |
| 6,652,049 | B1 * | 11/2003 | Tyner | E06B 7/34 312/321.5 |
| 6,879,483 | B2 * | 4/2005 | Johnson | H02B 1/28 312/265.5 |
| 7,938,279 | B2 | 5/2011 | Kaplan | 211/119.009 |
| 8,777,339 | B2 | 7/2014 | Tassin | E06B 7/34 211/119.004 |
| 8,944,532 | B2 * | 2/2015 | Tontarelli | A47B 47/042 312/108 |
| 2003/0070768 | A1 | 4/2003 | Lewis et al. | 160/92 |
| 2005/0073224 | A1 * | 4/2005 | Livingston | A47B 47/0091 312/265.6 |
| 2005/0204694 | A1 * | 9/2005 | Tallman | A47B 87/0207 52/750 |
| 2007/0158957 | A1 | 7/2007 | Kramer et al. | |
| 2007/0278915 | A1 * | 12/2007 | Conrardy | H01M 2/1077 312/257.1 |
| 2008/0230500 | A1 | 9/2008 | Johnson | 211/119.004 |
| 2009/0200903 | A1 * | 8/2009 | Tassin | A47B 46/00 312/326 |
| 2012/0001529 | A1 * | 1/2012 | Rahilly | A47B 61/02 312/334.1 |
| 2012/0141247 | A1 * | 6/2012 | Levy | G06Q 10/06 414/806 |
| 2014/0217860 | A1 * | 8/2014 | Chen | G07F 9/10 312/35 |
| 2014/0327350 | A1 * | 11/2014 | Tassin | A47B 46/00 312/249.7 |
| 2016/0073532 | A1 * | 3/2016 | Podemski | H05K 7/02 312/223.1 |

* cited by examiner

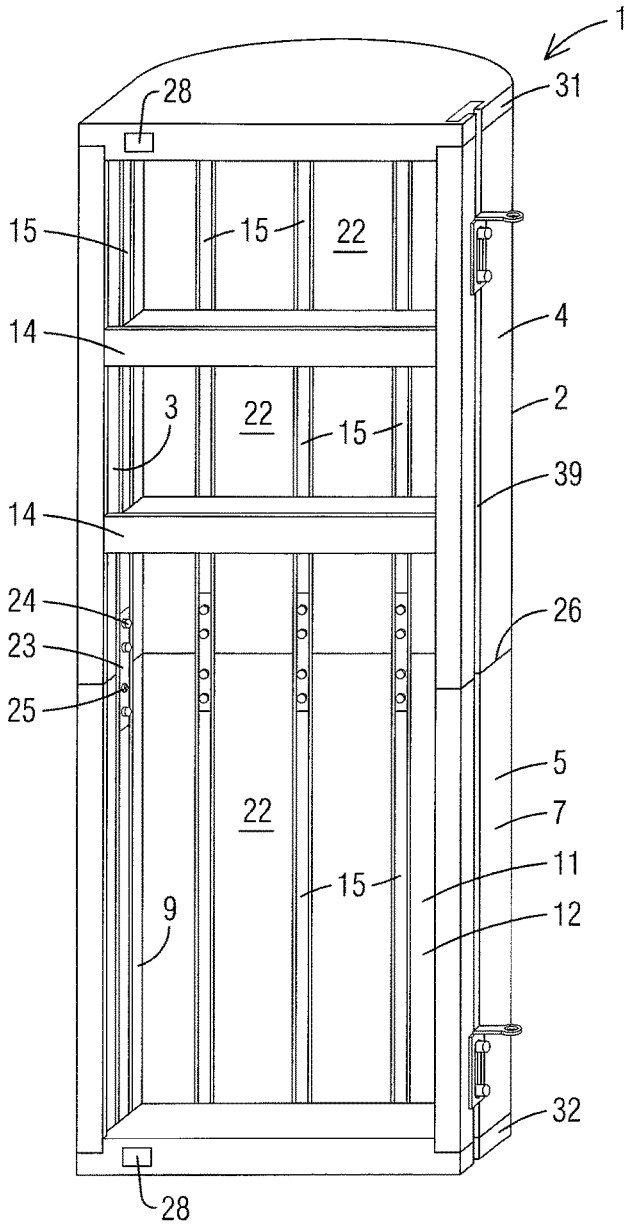
FIG. 1
FIG. 3
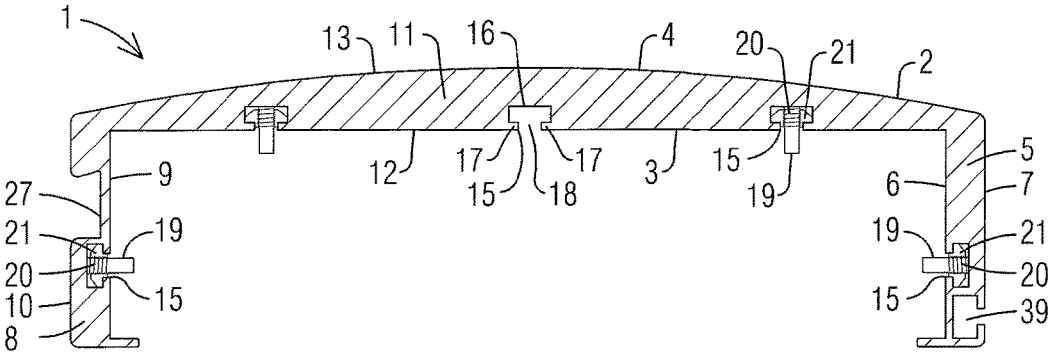

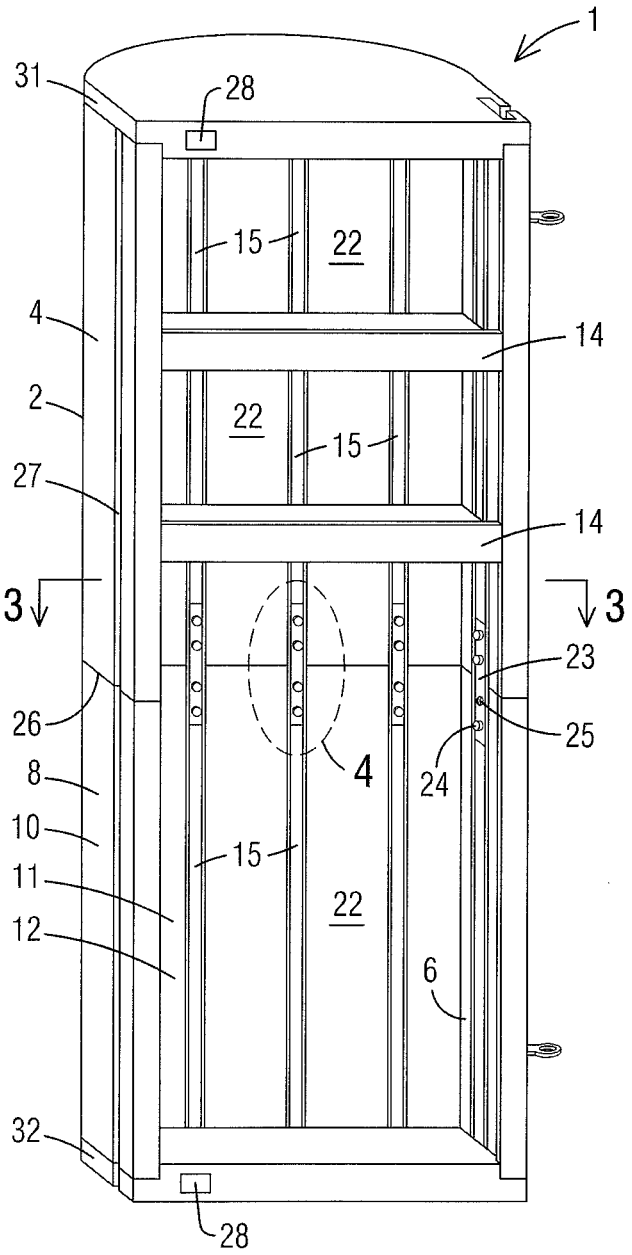
FIG. 2
FIG. 4
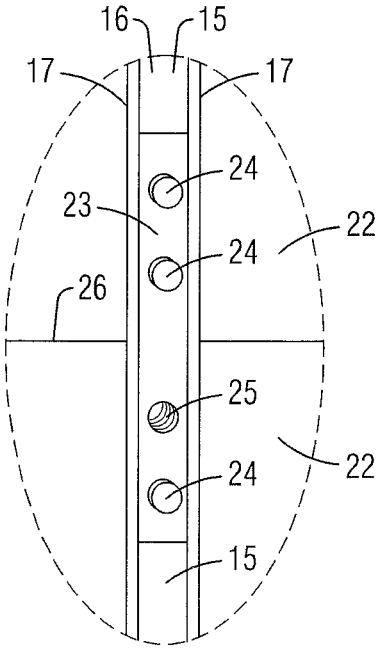

HINGE MOUNTED CABINET

FIELD OF THE INVENTION

This invention relates to storage devices and more particularly to a cabinet that is mountable to one or more existing hinges and hinge pins of a door.

BACKGROUND OF THE INVENTION

Additional storage has always been a desirable commodity in homes and other structures where space is at a premium. One overlooked area in the past has been the space located behind doors. Storage devices have been developed in the past that hang over the upper edge of doors on hooks and/or attach directly to a rear surface of a door with screws, bolts and/or adhesives. However, these devices may damage the door's finish, damage the structural integrity of the door and/or make it difficult for the door to close by interfering with the door jam.

An additional problem with conventional door mounted cabinets is the size and weight of the devices, which make shipping and transportation expensive and add unnecessary weight to the door when installed thereon.

Therefore, a need exists for a hinge mounted cabinet that that is mountable to one or more existing hinges and hinge pins of a door wherein the weight of the cabinet is supported by the existing hinges, not the door, and a hinge mounted cabinet that is preferably light, modular and easy to install on any configuration of hinges.

SUMMARY OF THE INVENTION

The primary object of the present invention is to provide a cabinet that that is mountable to one or more existing hinges and hinge pins of a door wherein the weight of the cabinet is supported by the existing door hinges and not the door and a hinge mounted cabinet that is preferably light, modular and easy to install on any configuration of hinges.

The present invention fulfills the above and other objects by providing a cabinet that can be assembled from one or more sections using a plurality of internal support channels that are locked together using splines and caps to form a main body of the cabinet. An exterior support channel allows hinge hanging brackets to be easily positioned to accommodate various sized doors and hinge configurations. The use of internal support channels and external support channels eliminates the need for apertures in the main body of the cabinet. Therefore, the cabinet and sections thereof are ideally manufactured using plastic extrusion.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which:

FIG. 1 is a perspective interior view of a cabinet from the interior side of the cabinet;

FIG. 2 is a perspective interior view of a cabinet from the exterior side of the cabinet;

FIG. 3 is a sectional view along line 3-3 of FIG. 2;

FIG. 4 is a magnified view of line 4-4 of FIG. 2;

DESCRIPTION OF THE PREFERRED EMBODIMENTS

Figure 5:
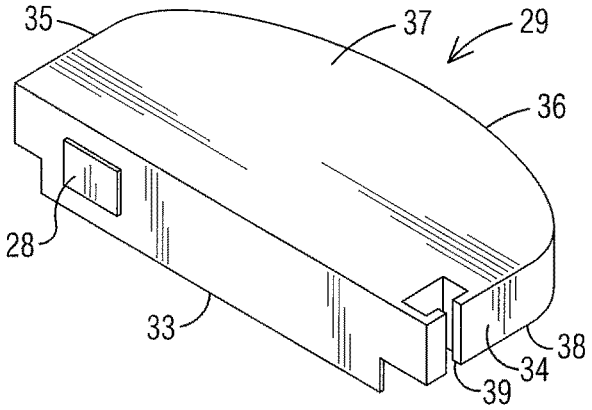
FIG. 5 is a perspective top view of right-slotted cap of the present invention.

For purposes of describing the preferred embodiment, the terminology used in reference to the numbered components in the drawings is as follows:

| | |
|---|---|
| 1. | cabinet, generally |
| 2. | main body |
| 3. | interior surface of main body |
| 4. | exterior surface of main body |
| 5. | interior side panel of main body |
| 6. | interior surface of interior side panel |
| 7. | exterior surface of interior side panel |
| 8. | exterior side panel of main body |
| 9. | interior surface of exterior side panel |
| 10. | exterior surface of exterior side panel |
| 11. | rear panel of main body |
| 12. | interior surface of rear panel |
| 13. | exterior surface of main body |
| 14. | shelf |
| 15. | interior support channel |
| 16. | recessed groove |
| 17. | flange |
| 18. | slot |
| 19. | support post |
| 20. | threaded portion of support post |
| 21. | nut |
| 22. | section of the main body |
| 23. | spline |
| 24. | bolt |
| 25. | threaded aperture |
| 26. | joint line trim |
| 27. | handle |
| 28. | magnet |
| 29. | right slotted cap |
| 30. | left slotted cap |
| 31. | top of main body |
| 32. | bottom of main body |
| 33. | front edge of cap |
| 34. | side interior edge of cap |
| 35. | side exterior edge of cap |
| 36. | rear edge of cap |
| 37. | top surface of cap |
| 38. | bottom surface of cap |
| 39. | exterior support channel |
| 40. | hinge hanging bracket |
| 41. | door hinge |
| 42. | insert |
| 43. | rectangular-shaped plate |
| 44. | top of rectangular-shaped plate |
| 45. | bottom of rectangular-shaped plate |
| 46. | side of rectangular-shaped plate |
| 47. | aperture on rectangular-shaped plate |
| 48. | arm |

-continued

| | |
|---|---|
| 49. | proximal end of arm |
| 50. | distal end of arm |
| 51. | ring |
| 52. | ring aperture |
| 53. | diameter of ring |
| 54. | width of arm |
| 55. | internal mounting plate |
| 56. | aperture on internal mounting plate |
| 57. | nut |
| 58. | bolt |
| 59. | hinge pin |
| 60. | retaining channels |
| 61. | side edge of rear panel |
| 62. | side edge of insert |
| 63. | clip |

With reference to FIGS. 1-5, the cabinet 1 of the present invention comprises a main body 2 having an interior surface 3 and an exterior surface 4, an interior side panel 5 having an interior surface 6 and an exterior surface 7, an exterior side panel 8 having an interior surface 9 and an exterior surface 10 and a rear panel 11 having an interior surface 12 and an exterior surface 13. The main body 2 houses an open storage area for placing one or more shelves 14 that extend across the cabinet 1 from the interior side panel 5 to the exterior side panel 8. The rear panel 11 may be flat or curved as illustrated herein.

Interior support channels 15 are preferably located on the interior surface 3 of the main body 2. The interior support channels 15 preferably run vertically along the interior surfaces 6, 9 and 12 of the interior side panel 5, the exterior side panel 8 and the rear panel 11. The interior support channels 15 comprise a recessed groove 16 partially covered by two flanges 17 that extend inward a predetermined distance over the recessed groove 16 to form a slot 18 that allows access to the recessed groove 16 through which various attachment means may be inserted and secured. Support posts 19 (as illustrated in FIG. 3) comprising a threaded portion 20 and nut 21 may be inserted into the interior support channel 15 and locked into desired positions to adjust heights of one or more shelves 14 within the main body 2. The support posts 19 are locked into position by rotating the threaded portion 20 of the support post 19 in relation to the nut 21 located within a recessed groove 16 of the interior support channel 15, thereby creating a pressure fit between the support post 19, nut 21 and the flanges 17 of the interior support channel 15.

The main body 2 of the cabinet 1 may be a modular unit wherein the main body 2 comprises one or more sections 22 that may be attached to each other to make a taller cabinet 1. The sections 22 are preferably secured together using one or more splines 23 that are inserted into the interior support channels 15 located on the interior surface 3 of the main body 2 and, thus, the sections 22 thereof. The splines 23 are secured using threaded bolts 24 that engage threaded apertures 25 located on the splines 23, as illustrated in FIG. 4. A joint line 26 located between the sections 22 may be covered using a piece of trim 27 that attaches to the exterior surface 4 of the main body 2.

A handle 27, which may be recessed, is preferably located on the exterior surface 10 of the exterior side panel 8 to allow a user to open and close the cabinet 1. A magnet 28 located on the cabinet 1 keeps the cabinet 1 in a closed position against the door by engaging a corresponding magnet 28 that may be installed on the door.

Figure 6:
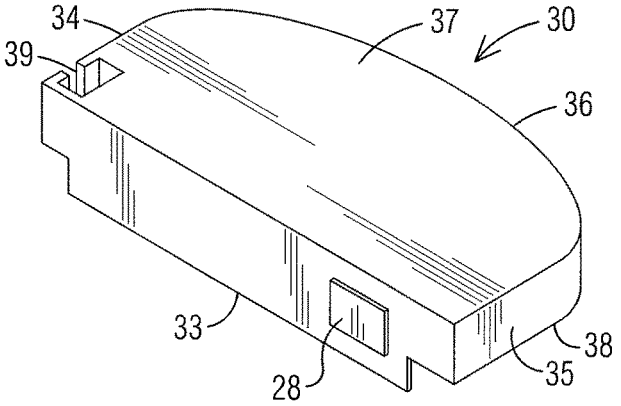
FIG. 6 is a perspective top view of left-slotted cap of the present invention.

As illustrated in FIGS. 5 and 6, a perspective top view of a right slotted cap 29 and a perspective top view of a left slotted cap 30, respectively, are illustrated. The caps 29, 30 attach to a top 31 and bottom 32 of the main body 2. Each cap 29, 30 comprises a front edge 33, side interior edge 34, side exterior edge 35, rear edge 36, top surface 37 and bottom surface 38. Exterior support channels 39 are located on the side interior edges 34 of both the right slotted cap 29 and the left slotted cap 30 in locations that align with the exterior support channel 39 located on the interior side panel 3 of the main body 2, as illustrated in FIGS. 1 and 3. This configuration allows the cabinet 1 to be installed on any door regardless of whether the door opens to the right or the left simply by flipping the cabinet 1 upside down so the interior side panel 3 faces the side of the door where hinges are installed so the exterior support channel 39 cannot be seen from the door knob side of the door.

Figure 7:
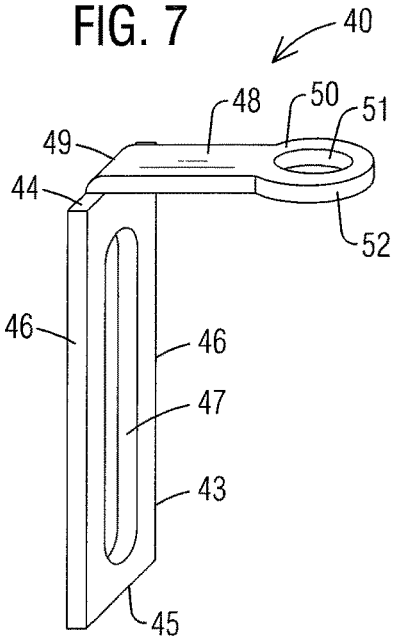
FIG. 7 is a perspective side view of a hinge hanging bracket of the present invention.
Figure 8:
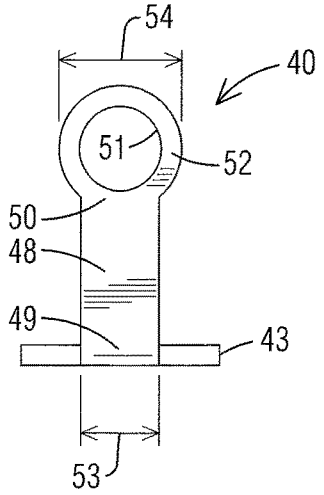
FIG. 8 is a top view of a hinge hanging bracket of the present invention.

With reference to FIGS. 7 and 8, a perspective side view of a hinge hanging bracket 40 of the present invention and a perspective top view of a hinge hanging bracket 40 of the present invention, respectively, are illustrated. The hinge hanging bracket 40 comprises a substantially rectangular-shaped plate 43 having a top 44, bottom 45, and sides 46. At least one aperture 47 is located on the substantially rectangular-shaped plate 43. An arm 48 having a proximal end 49 and distal end 50 extends from the top of the substantially rectangular-shaped plate 43. A ring 51 and aperture 52 are located on the distal end 50 of the arm 48. An additional feature of the hinge hanging bracket 40, is that the arm 48 has a width 53 that is less than a diameter 54 of ring 51 and the distal end 50 of the arm 48. The width 53 of the arm 48 provides clearance from obstructions, such as hinge plates, molding and so forth, so the hinge hanging bracket 40 can be swung back and forth a full 180 degrees in relation to a closed door and a parallel wall. The hinge hanging bracket 40 may also be used with a wall hanging bracket instead of a door hinge. The wall hanging bracket is an L-shaped bracket that attaches to a flat surface, such as a wall or a door, using screws and/or bolts. A stud or cylindrical projection extends from one end of the L-shaped bracket to engage the ring 51 and the distal end 50 of the arm 48

Figure 9:
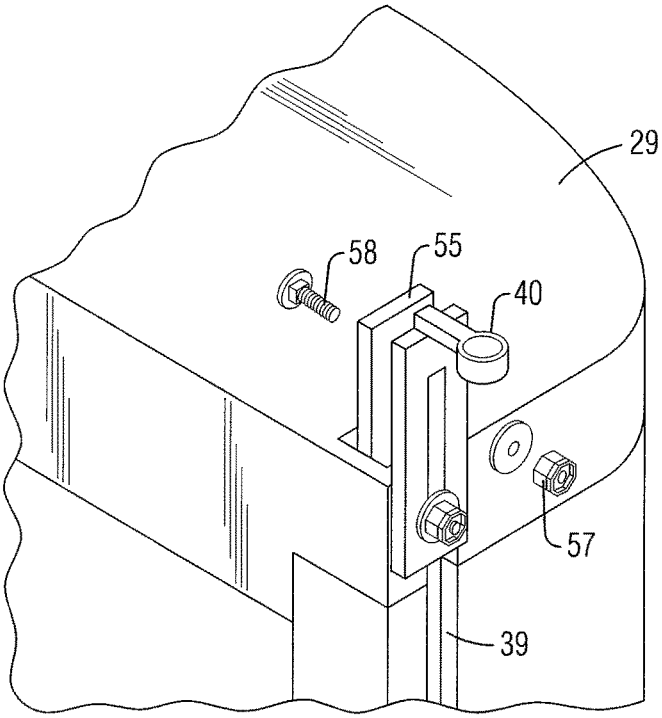
FIG. 9 is a perspective side view of a partially exploded hinge hanging bracket being installed on a cabinet of the present invention.
Figure 10:
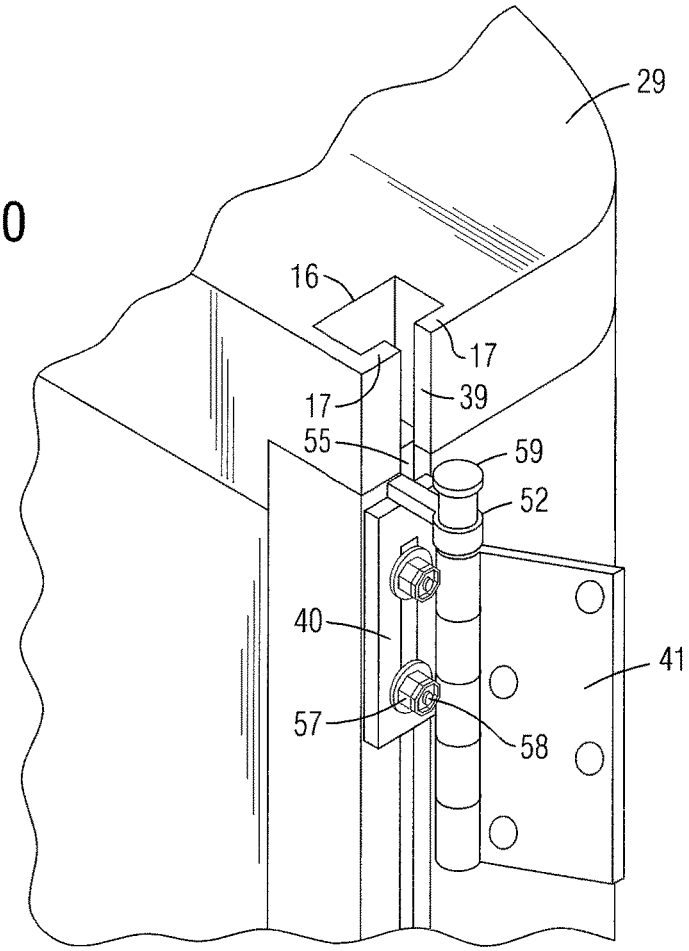
FIG. 10 is a perspective side view of a hinge hanging bracket installed on a cabinet of the present invention and a hinge.

With reference to FIGS. 9 and 10, a perspective side view of a partially exploded hinge hanging bracket 40 being installed on a cabinet 1 of the present invention and a perspective side view of a hinge hanging bracket 40 installed on a cabinet 1 and hinge 58, respectively, are illustrated. Exterior support channels 39 are located on the side interior edges 34 of both the right slotted cap 29 and the left slotted cap 30, as illustrated in FIGS. 4 and 5, in locations that align with the exterior support channel 39 located on the interior side panel 3 of the main body 2, as illustrated in FIGS. 1 and 3. The exterior support channels 39 comprise a recessed groove 16 partially covered by two flanges 17 that extend inward a predetermined distance over the recessed groove 16 to form a slot 18 that allows access to the recessed groove 16. One or more hinge hanging brackets 40 may be secured to the interior side panel 3 by inserting an internal mounting plate 55 comprising at least one aperture 56 into the exterior support channel 39. The internal mounting plate 55 is secured to the hinge hanging bracket 40 by one or more nuts 57 and bolts 58 that allow the internal mounting plate 55 and hinge hanging bracket 40 to be tightened together, thereby sandwiching the flanges 17 of the exterior support channel 39 between the internal mounting plate 55 and hinge hanging bracket 40.

The hinge hanging bracket 40 may be installed on a conventional door hinge 41 by removing a hinge pin 59 from a the door hinge 41 and then placing the hinge pin 59 through the aperture 52 located on the distal end 50 of the arm 48 and back into the door hinge 41. The hinge hanging bracket 40 may then be rotated on the door hinge 41 and hinge pin 59, thereby allowing the cabinet 1 to be opened and closed.

Figure 11:
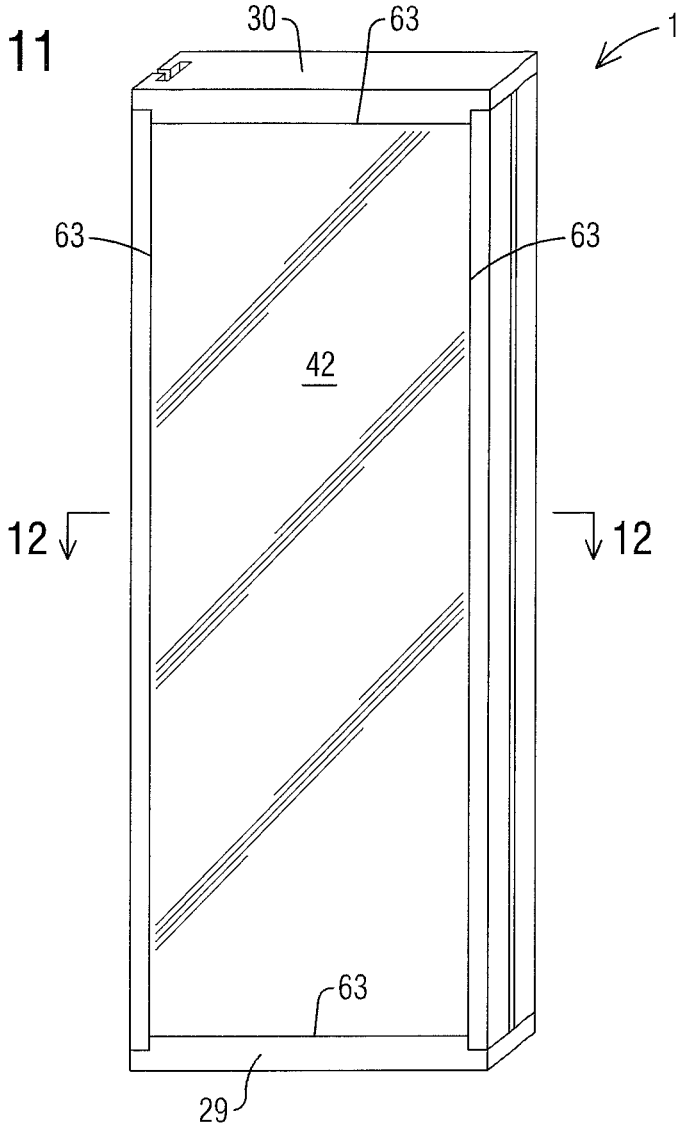
FIG. 11 is a rear perspective view of a hinge mounted cabinet of the present invention having an insert secured to the rear panel.
Figure 12:
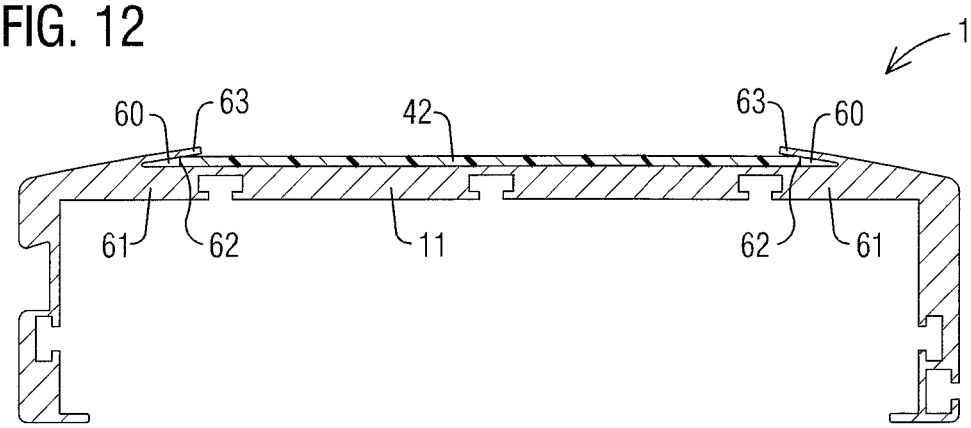
FIG. 12 is a sectional view along line 12-12 of FIG. 11.

With reference to FIGS. 11 and 12, a rear perspective view of a hinge mounted cabinet 1 of the present invention having an insert 42 secured to the rear panel 11 and a sectional view along line 12-12 of FIG. 11, respectively, are illustrated. The insert 42 is preferably a rectangular-shaped piece of material, such as mirror, dry erase board, chalk board, cork board, peg board and so forth, that is attached to the rear panel 11 via an attachment means, such as adhesive, clips and so forth. As illustrated in FIG. 12, the insert 42 is attached to the cabinet 1 using retaining channels 60 located on side edges 61 of the rear panel 11. The retaining channels 60 are formed by clips 63 that extend outward from the rear panel 11 a predetermined distance and hold side edges 62 of the insert 42 against the rear panel 11, thereby sandwiching the side edges 62 of the insert 42 between the clips 63 and the rear panel 11. The retaining channels 60 and clips 63 may also be located on the caps 29, 30 to secure upper and lower edges of the insert 42.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, we claim:

1. A cabinet that is mountable to hinges having hinge pins used to hang a door hung in a door jam so that said cabinet can be pivoted upon the hinge pins independently of the door, said cabinet comprising:

a main body having an interior side panel having an interior surface and an exterior surface, an exterior side panel having an interior surface and an exterior surface and a rear panel having an interior surface and an exterior surface;

said main body housing an open storage area for placing one or more shelves that extend across the cabinet from the interior side panel to the exterior side panel;

a first cap located on a top end of the main body;

said first cap having a front edge, interior side edge, exterior side edge, rear edge, top surface and bottom surface;

a second cap located on a bottom end of the main body;

said second cap having a front edge, side interior edge, side exterior edge, rear edge, top surface and bottom surface;

an exterior support channel located on the interior side edge of the first cap; and an exterior support channel located on the interior side edge of the second cap;

at least one exterior support channel located on the exterior surface of the interior side panel; and at least one hinge hanging bracket attached to the at least one exterior support channel.

2. The cabinet of claim 1 further wherein:

said main body comprises at least two sections secured together via at least one an attachment means.

3. The cabinet of claim 1 further comprising:

at least one interior support channel located on an interior surface of the main body.

4. The cabinet of claim 2 further comprising:

at least one interior support channel located on an interior surface of the main body; and said at least two sections of the main body are attached together via at least one spline located within the at least one interior support channel.

5. The cabinet of claim 1 wherein:

said at least one exterior support channel comprises a recessed groove partially covered by two flanges that extend inward a predetermined distance over the recessed groove to form a slot that allows access to the recessed groove.

6. The cabinet of claim 3 wherein:

said at least one interior support channel comprises a recessed groove partially covered by two flanges that extend inward a predetermined distance over the recessed groove to form a slot that allows access to the recessed groove.

7. The cabinet of claim 3 wherein:

said at least one interior support channel comprises a recessed groove partially covered by two flanges that extend inward a predetermined distance over the recessed groove to form a slot that allows access to the recessed groove.

8. The cabinet of claim 1 wherein:

said exterior surface of the rear panel of the main body is curved.

9. The cabinet of claim 1 wherein:

said exterior surface of the rear panel of the main body is substantially flat.

10. The cabinet of claim 1 wherein:

said exterior surface of the rear panel of the main body further comprises an attachable insert.

11. A cabinet that is mountable to hinges having hinge pins used to hang a door hung in a door jam so that said cabinet can be pivoted upon the hinge pins independently of the door, said cabinet comprising:

a main body having an interior side panel having an interior surface and an exterior surface, an exterior side panel having an interior surface and an exterior surface and a rear panel having an interior surface and an exterior surface;

said main body housing an open storage area for placing one or more shelves that 5 extend across the cabinet from the interior side panel to the exterior side panel;

a first cap located on a top end of the main body;

said first cap having a front edge, interior side edge, exterior side edge, rear edge, top surface and bottom surface;

a second cap located on a bottom end of the main body;

said second cap having a front edge, side interior edge, side exterior edge, rear edge, top surface and bottom surface;

an exterior support channel located on the interior side edge of the first cap; and an exterior support channel located on the interior side edge of the second cap;

at least one exterior support channel located on the exterior surface of the interior side panel;

at least one hinge hanging bracket attached to the at least one exterior support channel; and said main body comprises at least two sections secured together via at least one an attachment means.

12. The cabinet of claim 11 further comprising:

at least one interior support channel located on an interior surface of the main body; and said at least two sections of the main body are attached together via at least one spline located within the at least one interior support channel.

13. The cabinet of claim 11 wherein:

said at least one exterior support channel comprises a recessed groove partially covered by two flanges that inward a predetermined distance over the recessed groove to form a slot that allows access to the recessed groove.

14. The cabinet of claim 12 wherein:

said at least one interior support channel comprises a recessed groove partially covered by two flanges that extend inward a predetermined distance over the recessed groove to form a slot that allows access to the recessed groove.

15. The cabinet of claim 11 wherein:

said exterior surface of the rear panel of the main body is curved.

16. The cabinet of claim 11 wherein:

said exterior surface of the rear panel of the main body is substantially flat.

17. The cabinet of claim 11 wherein:

said exterior surface of the rear panel of the main body further comprises an attachable insert.

* * * * *